United States Patent [19]

Ito

[11] Patent Number: 4,589,394

[45] Date of Patent: May 20, 1986

[54] INJECTION TIMING CONTROL DEVICE IN A DISTRIBUTOR-TYPE FUEL INJECTION PUMP

[75] Inventor: Satoru Ito, Higashimatsuyama, Japan

[73] Assignee: Diesel Kiki Co., Ltd., Tokyo, Japan

[21] Appl. No.: 738,075

[22] Filed: May 24, 1985

[30] Foreign Application Priority Data

May 28, 1984 [JP] Japan ..... 59-78446[U]

[51] Int. Cl.[4] ..... F02M 59/20

[52] U.S. Cl. ..... 123/502

[58] Field of Search ..... 123/502, 501; 417/462

[56] References Cited

U.S. PATENT DOCUMENTS

| | | | |
|---|---|---|---|
| 3,101,078 | 8/1963 | Evans | 123/502 |
| 3,147,746 | 9/1964 | Hofer | 123/502 |
| 3,439,624 | 4/1969 | Glikin et al. | 123/502 |
| 4,353,343 | 10/1982 | Trachte | 123/502 |
| 4,368,709 | 1/1983 | Yasuhara | 123/502 |
| 4,502,449 | 3/1985 | Laufer | 123/502 |

FOREIGN PATENT DOCUMENTS

| | | | |
|---|---|---|---|
| 55-151124 | 11/1980 | Japan . | |
| 153827 | 12/1980 | Japan | 123/502 |
| 58-22994 | 5/1983 | Japan . | |
| 2057165 | 3/1981 | United Kingdom | 123/502 |

*Primary Examiner*—Magdalen Y. C. Moy

*Attorney, Agent, or Firm*—Frishauf, Holtz, Goodman & Woodward

[57] ABSTRACT

A distributor-type fuel injection pump for an internal combustion engine, having an injection timing control device for controlling the fuel injection timing by a timer piston displaceable in response to change of the fuel pressure within a suction space of the pump filled with fuel having a pressure variable as a function of the rotational speed of the engine. The pump housing has drain passage means formed in a partition wall thereof partitioning the injection timing control device from the suction space and in the timer piston, and communicating the suction space with a zone under a lower pressure, to always drain fuel within the suction space to the lower pressure zone during the operation of the pump. Therefore, a desired fuel injection timing characteristic substantially free of a hysteresis can be obtained within a predetermined rotational speed region of the engine.

3 Claims, 5 Drawing Figures

INJECTION TIMING CONTROL DEVICE IN A DISTRIBUTOR-TYPE FUEL INJECTION PUMP

BACKGROUND OF THE INVENTION

This invention relates to a distributor-type fuel injection pump for internal combustion engines, and more particularly to a distributor-type fuel injection pump having an injection timing control device which is adapted to control the internal pressure within the suction space so as to adjust the fuel injection timing characteristics.

In a conventional distributor-type fuel injection pump for internal combustion engines, the fuel pressure within the suction space (hereinafter merely called "the internal pressure") is controlled solely by a pressure regulating valve. Accordingly, the internal pressure varies linearly in proportion to a change in the rotational speed of the fuel injection pump, i.e. that in the rotational speed of the engine. As a result, an injection timing control device (a timer) provided in the pump and adapted to operate in response to a change in the internal pressure for control of the fuel injection timing can merely provide a fuel injection timing characteristic variable linearly relative to the engine rotational speed.

It is generally employed to retard the fuel injection timing in order to reduce the amount of noxious ingredients such as $NO_x$ in the exhaust gases emitted from the engine. However, in the conventional distributor-type fuel injection pump, it is not possible to retard the fuel injection timing in a particular engine speed region due to the above-mentioned linear fuel injection timing characteristic, thus failing to fully satisfy requirements imposed by the engine.

In order to satisfy the requirements by the engine, a distributor-type fuel injection pump has been proposed by Japanese Utility Model Publication No. 58-22994 or by Japanese Patent Provisional Publication No. 55-151124, wherein a member operable in response to the internal pressure such as a timer piston of the injection timing control device and the pressure regulating valve is formed therein with a fuel drain passage which is opened and closed in response to changes in the internal pressure, so as to vary the internal pressure.

However, in the proposed fuel injection pump, the fuel passage is merely opened or closed in response to the internal pressure, resulting in that the injection timing characteristic has a large hysteresis margin, i.e. a large difference in the amount of fuel injection timing advance between during increase of the engine speed and during decrease of same. Therefore, the proposed fuel injection pump is not fully suited to practical use.

SUMMARY OF THE INVENTION

It is the object of the invention to provide a distributor-type fuel injection pump for internal combustion engines, which is equipped with an injection timing control device capable of obtaining a fuel injection timing characteristic having a desired fuel injection advance amount in a particular speed region of the engine, and a very small hysteresis margin, to thereby fully satisfy various requirements by the engine.

The present invention provides a distributor-type fuel injection pump for an internal combustion engine, comprising: a pump housing; a suction space defined within the pump housing and filled with fuel having a pressure variable as a function of the rotational speed of the engine; a timer piston displaceable in response to a change in the fuel pressure; means for controlling the fuel injection timing of the fuel injection pump in response to displacement of the timer piston; and drain passage means partly formed in the timer piston for permanently communicating the suction space with a zone under a lower pressure, the drain passage means having a restricting portion which is disposed to restrict the flow rate of fuel flowing therethrough from the suction space to the zone under a lower pressure when the timer piston is positioned within a region corresponding to a particular rotational speed region of the engine.

The above and other objects, features and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
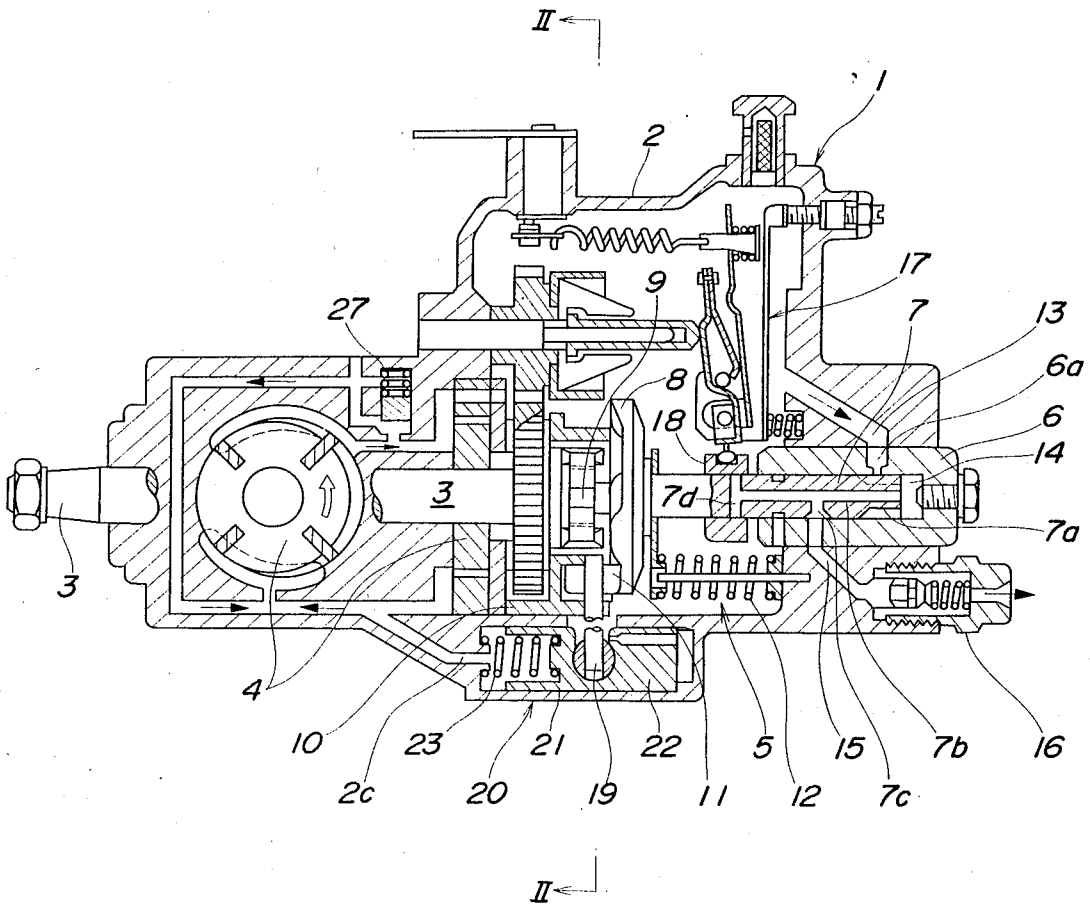
FIG. 1 is a longitudinal sectional view illustrating an embodiment of a distributor-type fuel injection pump according to the invention.

Referring first to FIG. 1, there is illustrated a distributor-type fuel injection pump for an internal combustion engine, according to an embodiment of the invention. A drive shaft 3 extends through an end portion of a pump housing 2 of the pump 1 and is connected to an output shaft of the engine, neither of which is shown. A feed pump 4 is formed by a vane pump and mounted on the drive shaft 3 to be rotatively driven thereby. The feed pump 4 sucks fuel from a fuel tank, not shown, pressurizes and supplies same to a suction space 5 defined within the pump housing 2 via a pressure regulating valve 27. Thus, the internal pressure (the fuel pressure) within the suction space 5 increases in proportion to increase of the rotational speed of the engine. In FIG. 1, the feed pump 4 is shown located on a plane turned by 90 degrees from the plane on which it is actually located, for the facility of understanding.

A plunger 7 is slidably fitted in a plunger barrel 6 mounted in the pump housing 2 in alignment with the drive shaft 3, for pumping and distributing of fuel. The plunger 7 axially reciprocates while simultaneously rotating about its own axis in unison with the rotation of the drive shaft 3. That is, the drive shaft 3 is drivingly connected with a cam disc 8 secured to one end of the plunger 7 by means of an Oldham's coupling 9, such that they are circumferentially movable in unison and axially movable relatively to each other. The cam disc 8 has a camming end face formed with highs corresponding in number to the cylinders of the engine and disposed in urging contact with a plurality of rollers 11 supported by a roller holder 10, by the force of a plunger spring 12.

While the plunger 7 is moving on the suction stroke, fuel within the suction space 5 is introduced into a hydraulic pressure chamber 14 defined between the plunger barrel 6 and one end of the plunger 7 through a fuel supply passage 13 formed in the pump housing 2, a suction port 6*a* formed in the plunger barrel 6, and a corresponding one of a plurality of suction slits 7*a* formed in an outer peripheral surface of the one end of the plunger 7. While the plunger 7 is moving on the compression stroke, the fuel within the hydraulic pressure chamber 14 is compressed by the plunger 7 when the communication between the suction port 6*a* and the corresponding one of the suction slits 7*a* is interrupted. The compressed fuel is then led through an axial hole 7*b* and a distributing port 7*c* both formed in the plunger 7 into one of a plurality of circumferentially arranged distributing passages 15 formed in the housing 2 and corresponding in number to the engine cylinders, and delivered to a corresponding one of delivery valves 16 to be injected to a corresponding one of the cylinders by a fuel injection nozzle, not shown.

A control sleeve 18 is axially slidably fitted on a portion of the plunger 7 projecting from the plunger barrel 6 into the suction space 5. The control sleeve 18 is engaged with a governor mechanism 17 arranged within the pump housing 2. When the plunger 7 on the compression stroke is further displaced rightward as viewd in FIG. 1, a cut-off port 7*d* formed in the plunger 7 in communication with the axial hole 7*b* is disengaged from an end face of the control sleeve 18 and opened into the suction space 5, and accordingly the compressed fuel within the plunger 7 escapes into the suction space 5 through the open cut-off port 7*d*. Thus, the pressure delivery of the fuel to the delivery valve 16 is terminated to terminate the fuel injection.

A timer 20 as an injection timing control device is provided at the bottom of the pump housing 2 and formed integrally therewith. The timer 20 is connected to the roller holder 10 by way of a connecting rod 19. In FIG. 1, the timer 20 is shown located on a plane turned by 90 degrees from the plane on which it is actually located, for the facility of understanding.

Figure 2:
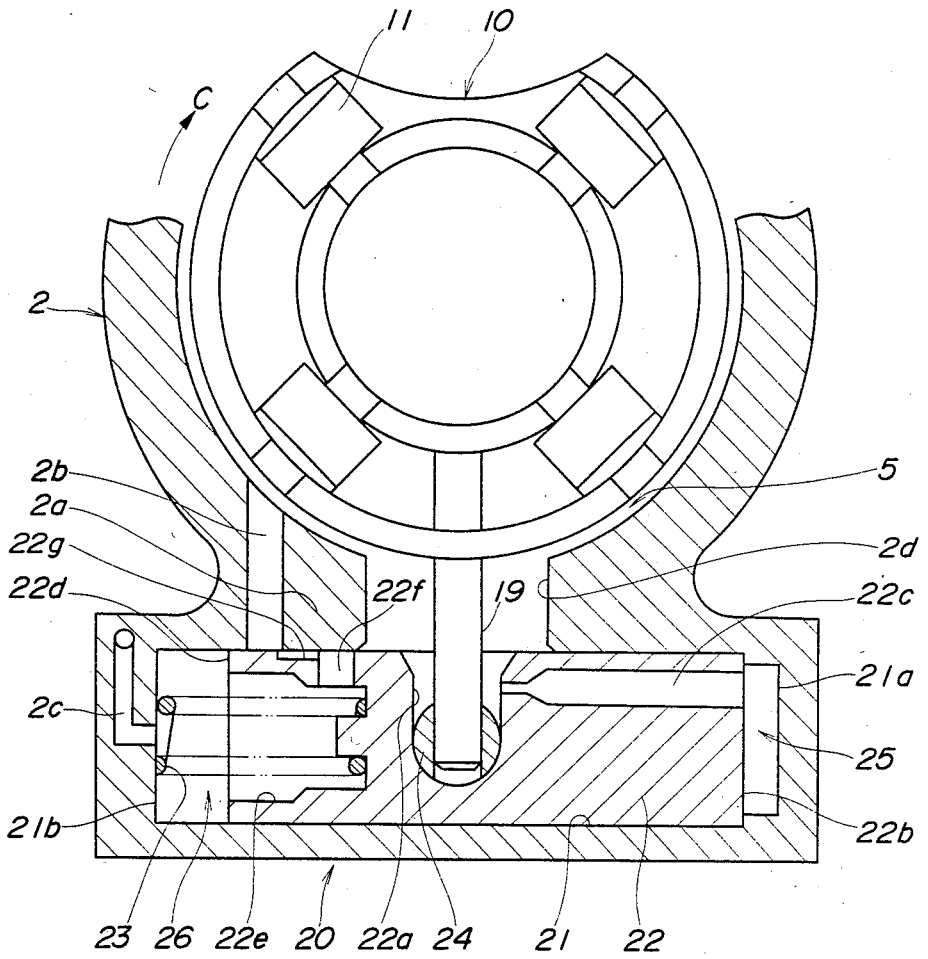
FIG. 2 is a transverse cross-sectional view taken along line II—II in FIG. 1, showing a roller holder and a timer both appearing in FIG. 1.

As shown in FIG. 2, the timer 20 comprises a cylinder 21 formed integrally with the bottom of the pump housing 2, a timer piston 22 axially slidably received within the cylinder 21, and a timer spring 23 disposed to bias the timer piston 22 in the direction of a hydraulic pressure chamber 25 defined between the cylinder 21 and one end of the timer piston 22. A hole 22*a* opens in an outer peripheral surface of the timer piston 22 at a substantially central location of the piston 22. The connecting rod 19 has one end fixed to the roller holder 10 at a lower location thereof and extends through an opening 2*d* formed through a partition wall 2*a* of the pump housing 2 partitioning the cylinder 21 of the timer 20 from the suction space 5. The other end of the connecting rod 19 is pivotally received in the hole 22*a* of the piston 22 through a ball 24.

Axially formed in the timer piston 22 is a passage 22*c* having one end opening into the hole 22*a* and the other end in an end face 22*b* of the timer piston 22 facing the hydraulic pressure chamber 25. A recess 22*e* is formed at the other end face 22*d* of the piston 22. The hydraulic pressure chamber 25 is defined between the one end face 22*b* and an opposed end face 21*a* of the cylinder 21. A spring chamber 26 is defined between the other end face 22*d* and the recess 22*e* of the piston 22 and an opposed end face 21*b* of the cylinder 21. The spring chamber 26 accommodates therein the timer spring 23 urging at one end the end face 21*b* of the cylinder 21 and at the other end a bottom face of the recess 22*e* to bias the timer piston 22 in the direction of the hydraulic pressure chamber 25. The spring chamber communicates with a zone under a lower pressure through a passage 2*c* formed in the cylinder 21 and the pump housing 2, as shown in FIGS. 1 and 2.

Further, a bore 22*f* is radially formed in the timer piston 22, which has one end opening into the recess 22*e* in the vicinity of the bottom face thereof and the other end opening in a portion of the outer peripheral surface of the piston 22 permanently disposed in sliding contact with an inner peripheral surface of the partition wall 2*a* forming part of the cylinder 21. A groove 22*g* as a restriction is formed in the outer peripheral surface of the timer piston 22. The groove 22*g* has one end continuous with the other end of the bore 22*f* and axially extends in the direction of the other end face 22*d*, with the other end terminating at a predetermined axial location. Preferably, the groove 22*g* has a flat bottom face extending parallel with the axis of the timer piston 22, and opposite lateral side faces extending parallel with each other.

The partition wall 2*a* of the pump housing 2 is formed therein with a bore 2*b* having one end opening into the suction space 5 and the other end terminating in an internal peripheral surface portion of the cylinder 21 permanently disposed in sliding contact with the timer piston 22. The axial location of the other end of the bore 2*b* is set such that when the timer piston is in a position corresponding to an advance of zero of the fuel injection timing, i.e. an initial position, as shown in FIG. 1, the other end of the bore 2*b* slightly overlaps with the other end of the groove 22*g*. The bore 2*b* formed in the partition wall 2*a* and the bore 22*f* formed in the timer piston 22 serve as a drain passageway for fuel within the suction space 5, and the groove 22*g* serves as a restriction which permanently communicates the passages 2*b*, 22*f* with each other.

Figure 3:
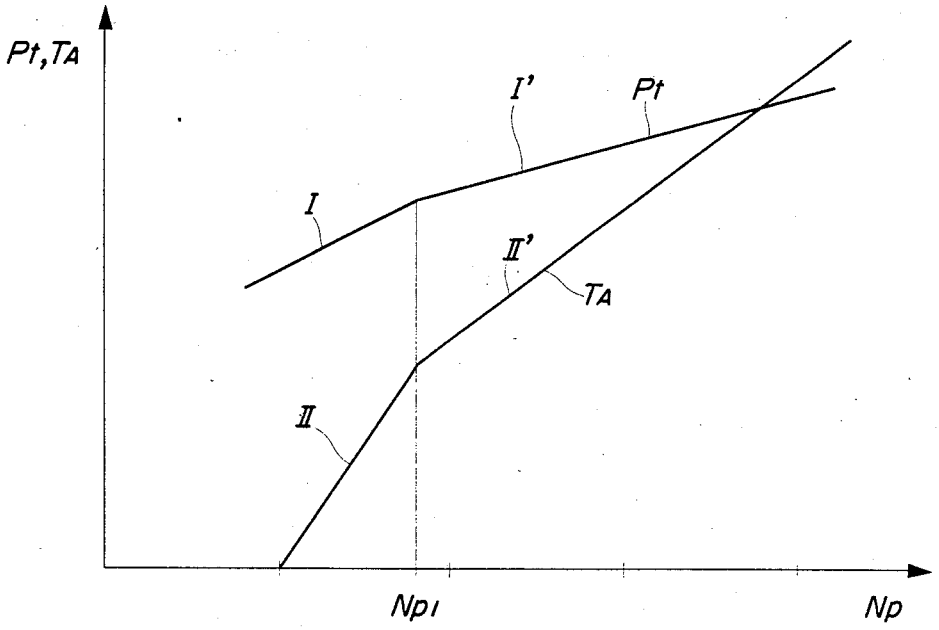
FIG. 3 is a graph showing a characteristic of internal pressure Pt within a suction space appearing in FIG. 1 as well as that of fuel injection timing advance TA of the timer appearing in FIG. 2.

With the above arrangement, after the engine is started, the internal pressure (fuel pressure) Pt within the suction space 5 increases with increase of the rotational speed of the drive shaft 3 or that of the rotational speed Np of the feed pump 4, as indicated by the solid line I in FIG. 3. Fuel within the suction space 5 flows to the spring chamber 26 in a restricted amount through the drain passage 2*b*, the communication groove 22*g*, and the drain passage 22*f*. The fuel further flows from the spring chamber 26 to the zone under a lower pressure through the passage 2*c*. On the other hand, fuel within the suction space 5 also flows to the hydraulic pressure chamber 25 through the opening 2*d*, the hole 22*a*, and the passage 22*c*, to urge the timer piston 22 against the force of the timer spring 23. Thus, with the increase of the internal pressure Pt, the timer piston 22 is gradually displaced leftward as viewed in FIG. 2. In response to the leftward displacement of the timer piston 22, the roller holder 10 rotates in a direction opposite to that of the rotation of the drive shaft 3, that is, in the clockwise direction as indicated by the arrow C in FIG. 2. In this manner, the fuel injection timing is advanced, as indicated by the line II in FIG. 3.

When the engine rotational speed, i.e. the rotational speed of the drive shaft 3 reaches a predetermined speed Npl, and accordingly the timer piston 22 is further displaced leftward as viewed in FIG. 2, the drain passage 22*f* is directly communicated with the drain passage 2*b*. As a consequence, an increased amount of fuel flows from the suction space 5 to the zone under a lower pressure through these passages 2*b* and 22*f*, the spring chamber 26, and the passage 2*c*, to reduce the increasing rate of the internal pressure Pt within the suction space 5, as indicated by the line I' in FIG. 3, and accordingly the increasing rate of the urging pressure acting upon the end face 22*b* of the timer piston 22, resulting in a drop in the leftward moving speed of the timer piston 22. As a result, the fuel injection advance TA increases at a relatively lower rate relative to an increase in the rotational speed Np of the drive shaft 3, as indicated by the line II' in FIG. 3.

In this manner, after the start of the engine, until the rotational speed Np of the drive shaft 3 reaches the predetermined speed Npl, the internal pressure Pt within the suction space 5 increases at a relatively large rate, as indicated by the line I in FIG. 3, and accordingly the fuel injection timing advance TA increases at a relatively large rate, as indicated by the line II in FIG. 3, while after the rotational speed Np of the drive shaft 3 has reached the predetermined speed Npl, the internal pressure Pt increases at a relatively small rate, as indicated by the line I' in FIG. 3, and accordingly the fuel injection timing advance TA increases at a relatively small rate, as indicated by the line II' in FIG. 3.

Thus, by suitably setting the locations and sizes of the drain passages 22*f*, 22*b* and the communication groove 22*g*, a desired characteristic of fuel injection advance TA can be obtained within a predetermined rotational speed region of the engine.

As described above, according to the arrangement of the invention, whatever position is assumed by the timer piston, i.e. the leftward and rightward extreme opposite positions and any intermediate position, the drain passage 22*f* is permanently kept in communication with the drain passage 2*b*, either through the communication groove 22*g* or directly, so that fuel within the suction space 5 always flows to the zone under a lower pressure during operation of the fuel injection pump 1. That is, as distinct from the conventional fuel injection pump hereinbefore described, in which a hysteresis is caused by a slight time lag between the time the drain passage is opened or closed in response to displacement of the timer piston and the time fuel escape actually starts or terminates, that is, the time decrease and increase in the internal pressure within the suction space takes place, the drain passage 22*f* in the fuel injection pump of the invention is never opened or closed during operation of the pump 1, thereby eliminating the above phenomena. As a result, a hysteresis margin in the internal pressure Pt between when the rotational speed Np of the drive shaft 3 increases and when the same rotational speed Np decreases can be reduced, thereby reducing a hysteresis margin in the fuel injection timing TA characteristic of the timer 20 to a practically negligible level.

Figure 4:
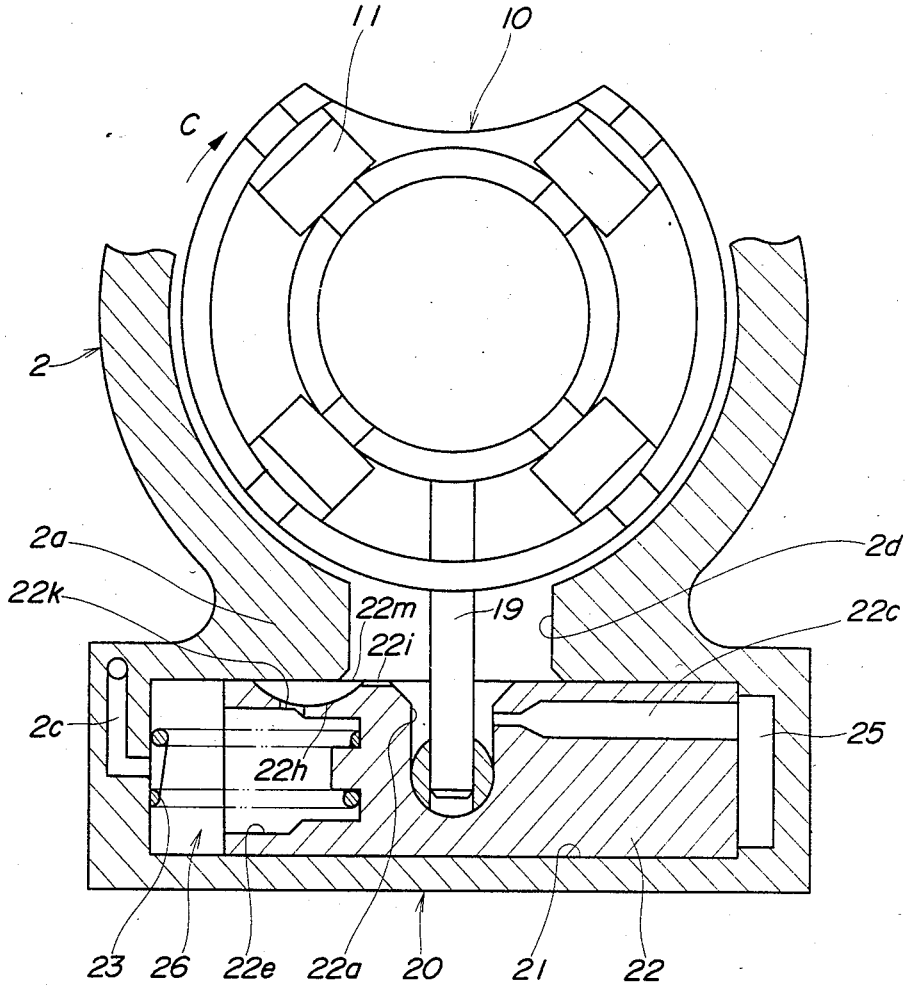
FIG. 4 is a similar view to FIG. 2, showing another embodiment of the invention.

FIG. 4 shows another embodiment of the invention, in which reference numerals identical with those in FIG. 2 indicate elements and parts corresponding to those in FIG. 2, of which description is omitted.

In FIG. 4, a recess 22*h* is formed in the outer peripheral surface of the timer piston 22 at a location close to the recess 22*e* and opposed to the inner peripheral surface of the partition wall 2*a* forming part of the cylinder 21. The recess 22*h* has a bottom face curved axially of the timer piston 22. Also formed in the outer peripheral surface of the timer piston 22 is a communication groove 22*i* as a restriction, which has one end opening into the hole 22*a* and faces the opening 2*d* of the pump housing 2. The other end of the communication groove 22*i* is continuous with the recess 22*h*. The timer piston 22 is further formed with a drain passage 22*k* extending between the recess 22*h* and the recess 22*e*, to communicate them with each other. Preferably, the communication groove 22*i* has a flat bottom face extending parallel with the axis of the timer piston 22, and opposite lateral side faces extending parallel with each other.

As shown in FIG. 4, an end portion of the recess 22*h* opens into the suction space 5 to define an opening 22*m* having a predetermined cross-sectional area in cooperation with an end of the partition wall 2*a* facing the hole 22*a*. The opening 22*m* forms a drain passage.

Figure 5:
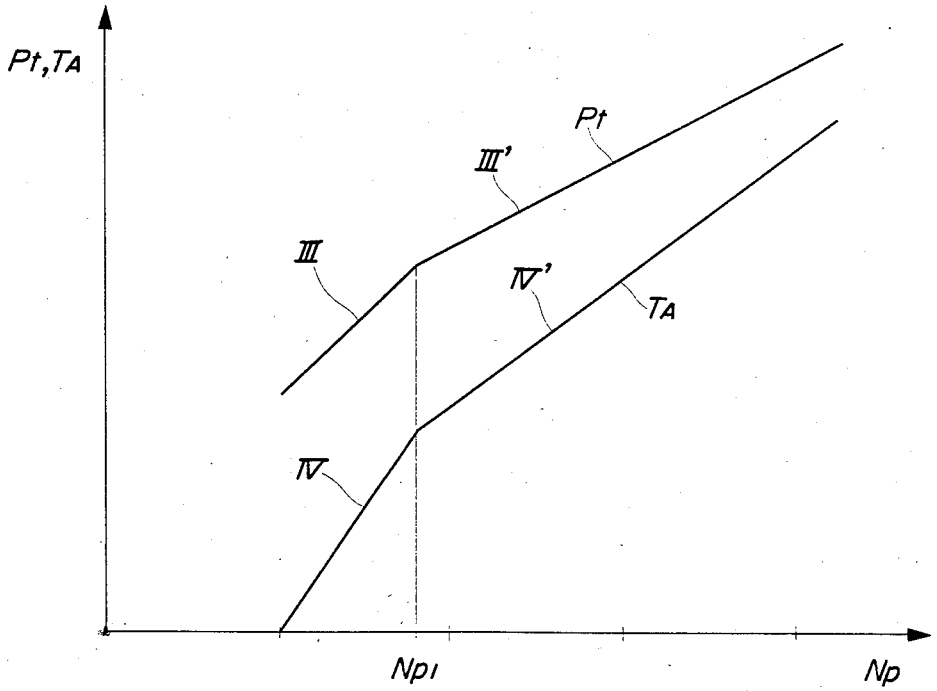
FIG. 5 is a graph showing a characteristic of internal pressure Pt within the suction space as well as that of fuel injection timing advance TA obtained by the timer appearing in FIG. 4.

In the fuel injection pump 1 constructed as above, after the start of the engine, fuel within the suction space 5 flows to the zone under a lower pressure through the drain passage 22*m*, the recess 22*h*, the drain passage 22*k*, and the spring chamber 26. Fuel within the suction space 5 is also supplied to the hydraulic pressure chamber 25 through the hole 22*a* and the passage 22*c*, to urgingly displace the timer piston 22 leftward, as viewed in FIG. 4, by applying thereto a pressure increasing in proportion to increase of the internal pressure Pt within the suction space 5 against the force of the timer spring 23. With the displacement of the timer piston 22, the cross-sectional area of the drain passage 22*m* gradually decreases to gradually reduce the amount of fuel flowing from the suction space 5 to the zone under a lower pressure. As a result, the internal pressure Pt within the suction space 5 increases at a relatively large rate, as indicated by the line III in FIG. 5. The fuel injection timing advance TA increases at a relatively large rate in repsponse to an increase in the internal pressure Pt, as indicated by the line III' in FIG. 5.

When the rotational speed of the drive shaft 3, i.e. that of the fuel injection pump 1 reaches a predetermined speed Npl, the timer piston 22 is further displaced leftward so that the drain passage 22*m* becomes completely closed by the partition wall 2*a*. As a result, the suction space 5 is communicated with the spring chamber 26 and with the zone under a lower pressure through the communication groove 22*i*, the recess 22*h*, and the drain passage 22*k*. Thereafter, during further leftward displacement of the timer piston 22, the cross-sectional area of the opening defined between the communication groove 22*i* and the partition wall 2*a* is kept at a substantially constant value so that the flow rate of fuel flowing from the suction space 5 to the zone under a lower pressure is kept substantially constant. As a result, the internal pressure Pt increases at a relatively small rate, as indicated by the line III' in FIG. 5, i.e. at a rate smaller than that indicated by the line III in FIG. 5. Accordingly, the fuel injection timing advance TA increases with the increase of the internal pressure Pt, as indicated by the line IV' in FIG. 5, that is, at a rate smaller than that indicated by the line IV in FIG. 5.

Thus, also in this embodiment, by setting the locations, sizes, and configurations of the recess 22*h*, drain passage 22*k*, and communication groove 22*i* to suitable ones, a desired fuel injection timing characteristic of the timer 20 can be obtained within a predetermined rotational speed range of the engine.

Further, whatever position the timer piston 22 assumes of the leftward and rightward extreme opposite positions and any intermediate position, the communication passage 22*i* permanently communicates the suction space 5 with the spring chamber 26, so that fuel within the suction space 5 always flows to the zone under a lower pressure during operation of the fuel injection pump 1. As a result, a desired injection timing characteristic can be obtained, which is free of a hysteresis conventionally caused by complete opening and closing of the drain passage 2*m*, as referred to in the description of the FIG. 2 embodiment.

Furthermore, a fuel injection pump according to the invention can be converted from a conventional fuel injection pump through simple machining of same without employing additional parts such as a special spring, thus being advantageous in reducing the manufacturing cost.

What is claimed is:

1. A distributor-type fuel injection pump for an internal combustion engine, comprising: a pump housing; a suction space defined within said pump housing and filled with fuel having a pressure variable as a function of the rotational speed of the engine; a timer piston displaceable in response to a change in said fuel pressure; means for controlling the fuel injection timing of said fuel injection pump in response to displacement of said timer piston; and drain passage means partly formed in said timer piston for permanently communicating said suction space with a zone under a lower pressure, said drain passage means having a restricting portion disposed to restrict the flow rate of fuel flowing therethrough from said suction space to said zone under a lower pressure when said timer piston is positioned within a region corresponding to a particular rotational speed region of said engine.

2. A distributor-type fuel injection pump as claimed in claim 1, wherein said pump housing has a cylinder formed integrally therewith and slidably receiving therein said timer piston, and a partition wall partitioning said cylinder from said suction space, said partition wall having an inner peripheral surface forming part of said cylinder, said timer piston and said cylinder defining therebetween a timer spring chamber communicating with said zone under a lower pressure, said timer piston having an outer peripheral surface, said drain passage means comprising a first passage formed in said partition wall and having one end opening into said suction space and another end opening in a portion of said inner peripheral surface of said partition wall in sliding contact with said timer piston, a second passage formed in said timer piston and having one end opening into said timer spring chamber and another end opening in said portion of said inner peripheral surface of said partition wall in sliding contact with said timer piston, and a groove formed in said outer peripheral surface of said timer piston as said restricting portion and having one end continuous with said other end of said second passage, said groove having an axial length such that when said timer piston is in an initial position assumed at the start of said engine, another end of said groove communicates with said other end of said first passage, and when said timer piston is displaced to a position corresponding to a predetermined rotational speed of said engine, said first passage and said second passage directly communicate with each other without intervention of said groove therebetween.

3. A distributor-type fuel injection pump as claimed in claim 1, wherein said pump housing has a cylinder formed integrally therewith and slidably receiving therein said timer piston, and a partition wall partitioning said cylinder from said suction space, said partition wall having an inner peripheral surface forming part of said cylinder, and an opening formed in said partition wall and communicating said suction space with said cylinder, said timer piston and said cylinder defining therebetween a timer spring chamber communicating with said zone under a lower pressure, said timer piston having an outer peripheral surface, said drain passage means comprising a recess formed in said outer peripheral surface of said timer piston at a location opposed to said inner peripheral surface of said partition wall, said recess having a bottom face curved axially of said timer piston, a groove formed in said outer peripheral surface of said timer piston as said restricting portion and continuous with said recess, and a passage formed in said timer piston and communicating said recess with said timer spring chamber, said recess and said groove being disposed in a manner such that when said timer piston is in an initial position assumed at the start of said engine, an end of said recess opens into said opening over a predetermined cross-sectional area, and at the same time said groove opens into said opening through a whole axial length thereof, and as said timer piston is thereafter displaced in response to increase of the rotational speed of said engine, said cross-sectional area over which said recess opens into said opening gradually decreases, and when said timer piston is displaced to a position corresponding to a predetermined rotational speed of said engine, said recess is closed by said inner peripheral surface of said partition wall, and at the same time communicates with said opening through said groove.

* * * * *